US009222660B2

(12) United States Patent
Kim et al.

(10) Patent No.: US 9,222,660 B2
(45) Date of Patent: Dec. 29, 2015

(54) LIGHTING DEVICE

(75) Inventors: Jae Jin Kim, Seoul (KR); Young Joo Ahn, Seoul (KR); Jae O Kwak, Seoul (KR); Ki Woong Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 13/581,505

(22) PCT Filed: Aug. 9, 2012

(86) PCT No.: PCT/KR2012/006336

§ 371 (c)(1),
(2), (4) Date: Aug. 28, 2012

(87) PCT Pub. No.: WO2013/022283

PCT Pub. Date: Feb. 14, 2013

(65) Prior Publication Data

US 2013/0039072 A1 Feb. 14, 2013

(30) Foreign Application Priority Data

| | | |
|---|---|---|
| Aug. 9, 2011 | (KR) | 10-2011-0078883 |
| Aug. 9, 2011 | (KR) | 10-2011-0078884 |
| Aug. 11, 2011 | (KR) | 10-2011-0079933 |
| Dec. 5, 2011 | (KR) | 10-2011-0128948 |

(51) Int. Cl.
*F21V 29/00* (2015.01)
*F21V 3/04* (2006.01)
(Continued)

(52) U.S. Cl.
CPC ..... *F21V 29/006* (2013.01); *F21V 3/0445* (2013.01); *F21V 7/041* (2013.01);
(Continued)

(58) Field of Classification Search
CPC ..... F21K 9/30; F21V 17/005; F21V 17/14; F21V 23/006; F21V 29/006; F21V 9/16; F21V 29/70; F21V 7/041; F21V 3/0445; F21Y 2101/02; F21Y 2105/001
USPC ..... 362/227, 374, 373, 362, 296.01, 257, 362/294, 249.02, 249.01, 244, 245, 236, 362/234, 375, 346, 297, 218, 547
See application file for complete search history.

(56) References Cited

U.S. PATENT DOCUMENTS 7,841,743 B2 * 11/2010 Wang et al. ..... 362/268
7,985,005 B2 7/2011 Alexander et al.
(Continued)

FOREIGN PATENT DOCUMENTS

EP 2 295 844 A2 3/2011
EP 2 461 094 A2 6/2012
(Continued)

OTHER PUBLICATIONS

International Search Report dated Feb. 14, 2013 issued in Application No. PCT/KR2012/006336.
(Continued)

*Primary Examiner* — Diane Lee
*Assistant Examiner* — Naomi M Wolford
(74) *Attorney, Agent, or Firm* — Ked & Associates, LLP

(57) ABSTRACT

A lighting device may be provided that includes: a housing having a top opening and a bottom opening; an optical plate disposed in the top opening; heat sink disposed in the bottom opening; a driving unit which is received in the housing, disposed between the optical plate and the heat sink and receives external electric power; and light source which is received in the housing, disposed between the optical plate and the driving unit, spatially separated from the driving unit and is electrically connected to the driving unit.

16 Claims, 13 Drawing Sheets

(51) Int. Cl.

| | |
|---|---|
| ***F21V 7/04*** | (2006.01) |
| ***F21V 17/00*** | (2006.01) |
| ***F21V 17/14*** | (2006.01) |
| ***F21V 23/00*** | (2015.01) |
| ***F21V 29/70*** | (2015.01) |
| ***F21V 9/16*** | (2006.01) |
| *F21Y 101/02* | (2006.01) |
| *F21Y 105/00* | (2006.01) |
| *F21K 99/00* | (2010.01) |

(52) U.S. Cl.

CPC ..... *F21V 9/16* (2013.01); *F21V 17/005* (2013.01); *F21V 17/14* (2013.01); *F21V 23/006* (2013.01); *F21V 29/70* (2015.01); *F21K 9/30* (2013.01); *F21Y 2101/02* (2013.01); *F21Y 2105/001* (2013.01)

(56) References Cited

U.S. PATENT DOCUMENTS

| | | | | |
|---|---|---|---|---|
| 2004/0115984 | A1* | 6/2004 | Rudy et al. | 439/405 |
| 2006/0291206 | A1* | 12/2006 | Angelini et al. | 362/244 |
| 2007/0268703 | A1 | 11/2007 | Gasquet et al. | |
| 2007/0279921 | A1* | 12/2007 | Alexander et al. | 362/368 |
| 2008/0158887 | A1* | 7/2008 | Zhu et al. | 362/294 |
| 2009/0073697 | A1 | 3/2009 | Peck et al. | |
| 2009/0213595 | A1* | 8/2009 | Alexander et al. | 362/373 |
| 2010/0084979 | A1 | 4/2010 | Burton et al. | 315/82 |
| 2010/0128479 | A1 | 5/2010 | Biebl et al. | |
| 2010/0259934 | A1* | 10/2010 | Liu et al. | 362/294 |
| 2010/0309671 | A1* | 12/2010 | Meyer et al. | 362/373 |
| 2011/0063837 | A1 | 3/2011 | Rizkin et al. | |
| 2011/0170294 | A1* | 7/2011 | Mier-Langner et al. | 362/294 |

FOREIGN PATENT DOCUMENTS

| | | | |
|---|---|---|---|
| JP | 2011-060458 | A | 3/2011 |
| KR | 10-2010-0135550 | A | 12/2010 |
| KR | 10-2011-0001229 | A | 1/2011 |
| KR | 10-1052605 | B1 | 7/2011 |
| WO | WO 2011/141846 | A2 | 11/2011 |

OTHER PUBLICATIONS

European Search Report issued in Application No. 12822483.9 dated Feb. 19, 2015.

* cited by examiner

600′

600″

600‴

LIGHTING DEVICE

CROSS-REFERENCE TO RELATED PATENT APPLICATIONS

The present application is a U.S national stage application under 35 U.S.C. 371 of PCT Application No. PCT/KR2012/006336, filed Aug. 9, 2012, which claims priority to Korean Patent Application Nos. 10-2011-0078883 and 10-2011-0078884, filed Aug. 9, 2011, No. 10-2011-0079933, filed Aug. 11, 2011, and No. 10-2011-0128948, filed Dec. 5, 2011, the entireties of which are incorporated herein by reference.

TECHNICAL FIELD

The embodiment relates to a lighting device.

BACKGROUND ART

A light emitting diode (LED) is a semiconductor element for converting electric energy into light. As compared with existing light sources such as a fluorescent lamp and an incandescent electric lamp and so on, the LED has advantages of low power consumption, a semi-permanent span of life, a rapid response speed, safety and an environment-friendliness. For this reason, many researches are devoted to substitution of the existing light sources with the LED. The LED is now increasingly used as a light source for lighting devices, for example, various lamps used interiorly and exteriorly, a liquid crystal display device, an electric sign and a street lamp and the like.

DISCLOSURE OF INVENTION

Technical Problem

The objective of the present invention is to provide a lighting device of which alight source can be separated from a driving unit.

The objective of the present invention is to provide a lighting device having improved heat radiation efficiency.

The objective of the present invention is to provide a lighting device of which the light source can be electrically connected to the driving unit.

The objective of the present invention is to provide a lighting device having improved optical efficiency.

The objective of the present invention is to provide a lighting device which is easy to assemble.

Solution to Problem

A lighting device includes: a housing having a top opening and a bottom opening; an optical plate disposed in the top opening; heat sink disposed in the bottom opening; a driving unit which is received in the housing, disposed between the optical plate and the heat sink and receives external electric power; and light source which is received in the housing, disposed between the optical plate and the driving unit, spatially separated from the driving unit and is electrically connected to the driving unit.

The lighting device includes a reflector which is received in the housing and is disposed between the optical plate and the light source.

The reflector includes: a reflecting portion which reflects light emitted from the light source to the optical plate; and a support which supports the reflecting portion on the heat sink, passes through the driving unit and is coupled to the heat sink.

The reflecting portion includes at least two inclined surfaces.

The light source includes both a substrate having a hole and a light emitting device. The reflecting portion includes a projection inserted into the hole of the substrate.

The three projections are provided. The three projections are disposed at different intervals from each other.

The housing includes a catching portion. The reflector includes a catching projection coupled to the catching portion. The catching projection is coupled to the catching portion by rotating about the direction in which the reflector is received in the housing.

A diameter of the optical plate is larger than a diameter of the top opening of the housing. The optical plate is fixed to the top opening of the housing by the coupling of the catching projection of the reflector and the catching portion of the housing.

The housing includes a key. The driving unit and the heat sink respectively include a key recess into which the key is inserted.

The key recess of the driving unit is larger than that of the heat sink.

A lighting device includes: a heat sink which includes a base and a projection disposed on the base; a light source which is disposed on the projection; and a driving unit which is disposed on the base and is electrically connected to the light source.

The projection is disposed at the central portion of the base.

The driving unit includes a circuit board and which receives electric power from the outside. The circuit board includes a hole through which the projection passes.

The lighting device includes a thermal pad disposed between the circuit board and the base of the heat sink.

The thermal pad is disposed on a portion of the base of the heat sink.

The lighting device includes a connector which electrically connects the light source with the driving unit and fixes the light source on the driving unit.

The connector includes a conductor and an insulating body in which the conductor is disposed and which includes an insertion recess. The light source of which a portion is inserted into the insertion recess of the insulating body includes an electrode pad electrically connected to the conductor. The driving unit includes a docking coupled to a portion of the insulating body and is electrically connected to the conductor of the connector.

The base of the heat sink has a hole. The projection is coupled to the hole.

The lighting device further includes a heat pipe disposed between the heat sink and the light source.

The heat sink has a heat pipe structure therewithin.

A lighting device includes: a heat sink; a driving unit which is disposed on the heat sink; a light source which is disposed on the driving unit; and a heat pipe of which a portion is disposed between the driving unit and the light source, which transfers heat generated from the light source to the heat sink and supports the light source such that the light source is disposed on the driving unit.

The heat pipe is bent in the form of a quadrangle.

Both ends of the heat pipe are disposed to be connected to each other or formed to face each other.

The at least two heat pipes are provided. The heat pipes are coupled to each other and have a quadrangular shape.

The heat sink includes a receiver for receiving a portion of the heat pipe in order to fix the heat pipe.

The receiver of the heat sink is disposed in at least one of a top surface, a lateral surface and a bottom surface of the heat sink.

The lighting device further includes a support plate disposed between the heat pipe and the light source.

Advantageous Effects of Invention

In a lighting device according to the embodiment, a light source can be separated from a driving unit.

In the lighting device according to the embodiment, heat radiation efficiency can be improved.

In the lighting device according to the embodiment, the light source can be electrically connected to the driving unit.

In the lighting device according to the embodiment, optical efficiency can be improved.

The lighting device according to the embodiment is easy to assemble.

MODE FOR THE INVENTION

A thickness or size of each layer is magnified, omitted or schematically shown for the purpose of convenience and clearness of description. The size of each component does not necessarily mean its actual size.

In description of embodiments of the present invention, when it is mentioned that an element is formed "on" or "under" another element, it means that the mention includes a case where two elements are formed directly contacting with each other or are formed such that at least one separate element is interposed between the two elements. The "on" and "under" will be described to include the upward and downward directions based on one element.

A lighting device according to an embodiment will be described with reference to the accompanying drawings.

Figure 1:
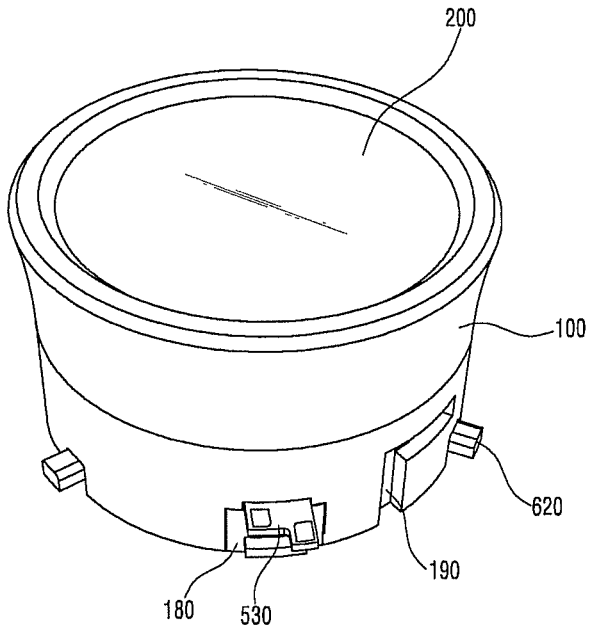
FIG. 1 is a top perspective view of a lighting device according to a first embodiment.
Figure 2:
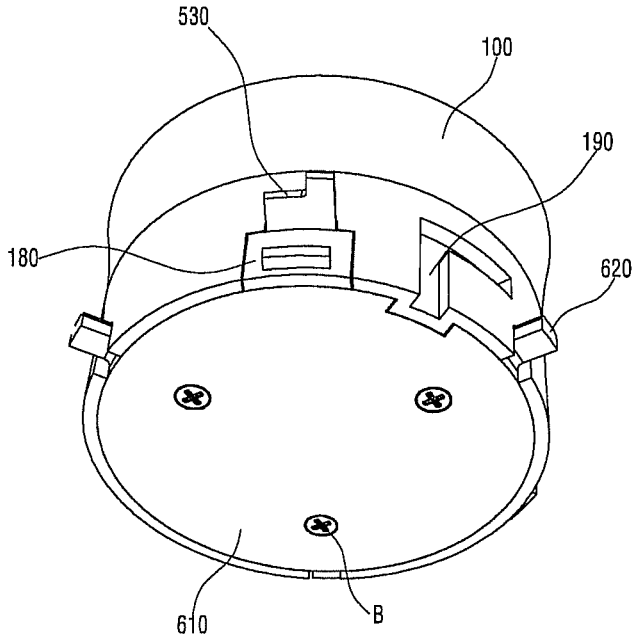
FIG. 2 is a bottom perspective view of the lighting device shown in FIG. 1.
Figure 3:
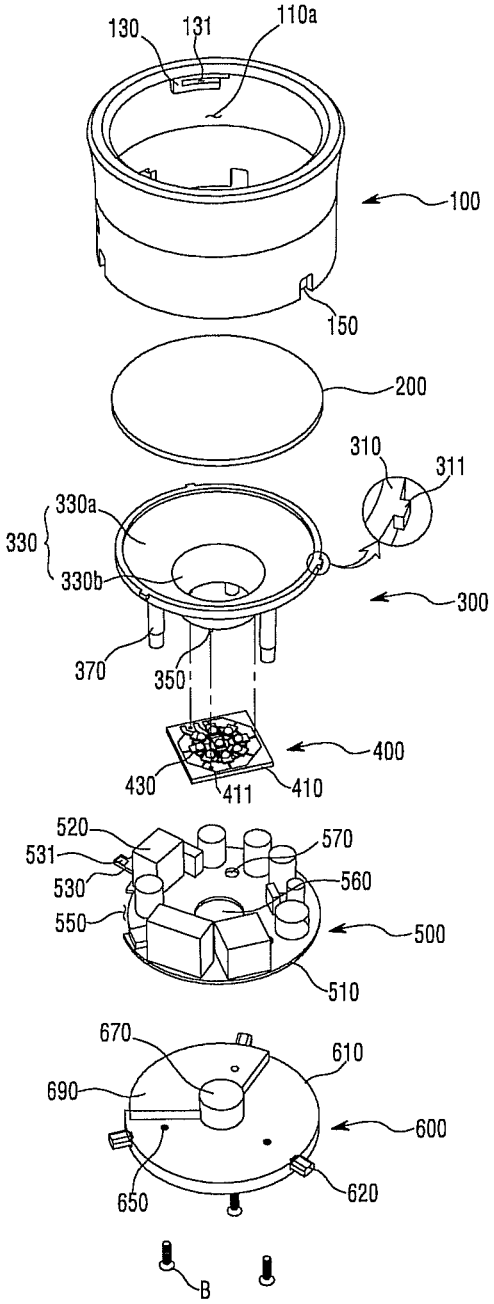
FIG. 3 is an exploded perspective view of the lighting device shown in FIG. 1.
Figure 4:
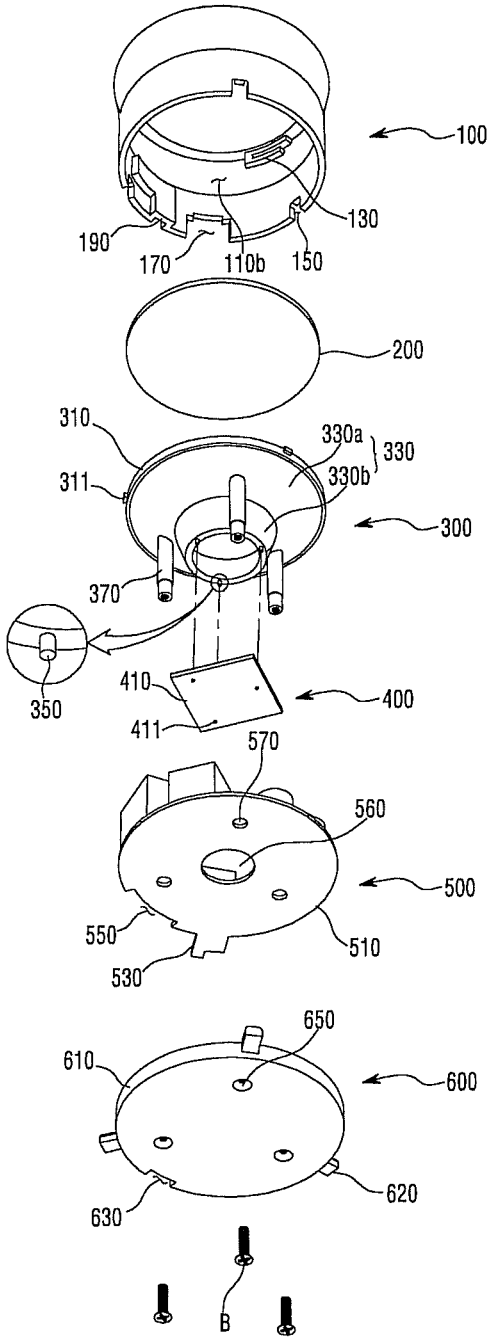
FIG. 4 is an exploded perspective view of the lighting device shown in FIG. 2.
Figure 5:
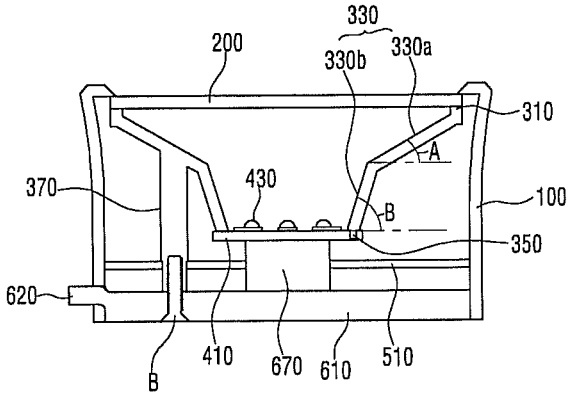
FIG. 5 is a cross sectional view of the lighting device shown in FIG. 1.

FIG. 1 is a top perspective view of a lighting device according to a first embodiment. FIG. 2 is a bottom perspective view of the lighting device shown in FIG. 1. FIG. 3 is an exploded perspective view of the lighting device shown in FIG. 1. FIG. 4 is an exploded perspective view of the lighting device shown in FIG. 2. FIG. 5 is a cross sectional view of the lighting device shown in FIG. 1.

Referring to FIGS. 1 to 5, the lighting device according to the embodiment may include a housing 100, an optical plate 200, a reflector 300, a light source 400, a driving unit 500 and a heat sink 600.

The housing 100 receives the optical plate 200, the reflector 300, the light source 400, the driving unit 500 and the heat sink 600. The housing 100 forms the external appearance of the lighting device according to the embodiment.

The housing 100 may have a cylindrical shape. However, there is no limit to the shape of the housing 100. The housing 100 may have a polygonal pillar shape.

The housing 100 has a shape with an empty interior in order to receive the optical plate 200, the reflector 300, the light source 400, the driving unit 500 and the heat sink 600. The cylindrical shape of the housing 100 has an open top surface and an open bottom surface. Therefore, the housing 100 has two openings. For convenience of the following description, the two openings are designated as a top opening 110*a* and a bottom opening 110*b* respectively.

The optical plate 200, the reflector 300, the light source 400, the driving unit 500 and the heat sink 600 may be sequentially received toward the top opening 110*a* through the bottom opening 110*b* of the housing 100.

The top opening 110*a* of the housing 100 is blocked by the optical plate 200. The diameter of the top opening 110*a* is designed to be less than that of the optical plate 200. Therefore, the optical plate 200 can block the top opening 110*a* of the housing 100.

The bottom opening 110*b* of the housing 100 is blocked by the heat sink 600. A projection 620 of the heat sink 600 is coupled to a first recess 150 of the housing 100, so that the heat sink 600 may block the bottom opening 110*b* of the housing 100.

The housing 100 may include at least one catching portion 130. Here, the number of the catching portions 130 may be equal to the number of catching projections 311 of the reflector 300.

The catching portion 130 of the housing 100 may be coupled to the catching projection 311 of the reflector 300. Specifically, the catching portion 130 may include an insertion recess 131 into which the catching projection 311 is inserted. The insertion recess 131 may have a predetermined length in a direction substantially perpendicular to the direction in which the reflector 300 is received in the housing 100. As the catching projection 311 moves along the insertion recess 131 or the catching projection 311 rotates about the direction in which the reflector 300 is received in the housing 100, the reflector 300 can be easily coupled to the housing 100 without a separate coupling means.

The housing 100 may include the first recess 150. The first recess 150 may be coupled to the projection 620 of the heat sink 600. The number of the first recesses 150 may correspond to the number of the projections 620. When the projection 620 of the heat sink 600 is inserted into the first recess 150 of the housing 100, the heat sink 600 comes to block the bottom opening 110*b* of the housing 100.

The housing 100 may include a second recess 170. An cover 180 and a projecting plate 530 of the driving unit 500 may be inserted into the second recess 170.

The cover 180 is inserted into the second recess 170 of the housing 100. After the projecting plate 530 of the driving unit 500 is inserted into the second recess 170 of the housing 100, the cover 180 blocks the remaining portion of the second recess 170. The cover 180 is able to prevent impurities which may be introduced into the housing 100.

The housing 100 may include a key 190. When the driving unit 500 and the heat sink 600 are received through the bottom opening 110*b* of the housing 100, the key 190 functions to indicate a direction in which the driving unit 500 and the heat sink 600 are coupled to each other and where the driving unit 500 and the heat sink 600 are coupled to each other.

The key 190 may have a shape dug from the outer surface to the inner surface of the housing 190. Thus, the key 190 may have a shape projecting from the inner surface of the housing 100.

The key 190 may be inserted into a key recess 550 of the driving unit 500 and inserted into a key recess 630 of the heat sink 600.

In the key 190, a portion of the key 190, which is coupled to the key recess 550 of the driving unit 500, may have a shape different from that of a portion of the key 190, which is coupled to the key recess 630 of the heat sink 600. Specifically, the key 190 may include a first key and a second key. The first key is inserted into the key recess 550 of the driving unit 500. The second key is inserted into the key recess 630 of the heat sink 600. The first key may have a volume greater than that of the second key. Therefore, the key recess 550 of the driving unit 500, which is inserted into the first key, may be larger than the key recess 630 of the heat sink 600, which is inserted into the second key.

Due to the housing 100 and the reflector 300, the optical plate 200 may block the top opening 110*a* of the housing 100. When the housing 100 is coupled to the reflector 300, the optical plate 200 is inserted and fixed between the housing 100 and the reflector 300. Therefore, the optical plate 200 may be disposed within the housing without a separate coupling means. Specifically, when an outer portion 310 of the reflector 300 pushes the optical plate 200 toward the top opening 110*a* from the bottom opening 110*b* of the housing 100, the optical plate 200 is fixed to the top opening 110*a* of the housing 100. This is because the diameter of the optical plate 200 is larger than that of the top opening 110*a* of the housing 100.

An opalescent pigment may be coated on the inner surface of the optical plate 200. The pigment may include a diffusing agent which diffuses light passing through the optical plate 200.

The optical plate 200 may be formed of glass. However, the glass is vulnerable to weight or external impact. Therefore, the optical plate 200 may be formed of plastic, polypropylene (PP), polyethylene (PE) and the like. Preferably, the optical plate 200 may be formed of polycarbonate (PC) which is used to diffuse light and has excellent light resistance, thermal resistance and impact strength.

The roughness of the inner surface of the optical plate 200 may be larger than that of the outer surface of the optical plate 200. In this case, it is possible to sufficiently scatter and diffuse light emitted from the light source 400.

The optical plate 200 is able to excite the light emitted from the light source 400. The optical plate 200 may have a fluorescent material in order to excite the light emitted from the light source 400. The fluorescent material may include at least any one selected from a group consisting of a garnet material (YAG, TAG), a silicate material, a nitride material and an oxynitride material. The optical plate 200 is able to convert the light emitted from the light source 400 into natural light (white light) by including a yellow fluorescent material. However, the optical plate 200 may further include a green fluorescent material or a red fluorescent material in order to improve a color rendering index and to reduce a color temperature. Here, an addition ratio of the color of the fluorescent material may be formed such that the green fluorescent material is more used than the red fluorescent material, and the yellow fluorescent material is more used than the green fluorescent material. The garnet material, the silicate material and the oxynitride material may be used as the yellow fluorescent material. The silicate material and the oxynitride material may be used as the green fluorescent material. The nitride material may be used as the red fluorescent material.

The reflector 300 is disposed within the housing 100. The reflector 300 is received in the interior space of the housing 100 through the bottom opening 110*b* of the housing 100.

The reflector 300 fixes the optical plate 200 to the inside of the housing 100. For this purpose, the reflector 300 may include the outer portion 310 and the catching projection 311.

The outer portion 310 is formed along the outer circumference of a reflecting portion 330. The outer portion of the optical plate 200 is disposed on the outer portion 310 of the reflector 300. The catching projection 311 may project or extend outwardly from the outer portion 310. Here, the catching projection 311 may project or extend in a direction substantially perpendicular to the direction in which the reflector 300 is received in the housing 100. The catching projection 311 may be inserted into the recess 131 of the catching portion 130 of the housing 100.

Describing an example in which the reflector 300 fixes the optical plate 200 to the inside of the housing 100, under the state where the optical plate 200 is disposed on the outer portion 310 of the reflector 300, the reflector 300 is received in the housing 100 and the catching projection 311 of the reflector 300 is coupled to the catching portion 130 of the housing 100, so that the optical plate 200 is fixed to the inside of the housing 100.

The reflector 300 may reflect the light emitted from the light source 400 toward the optical plate 200. The reflector 300 may include the reflecting portion 330.

The reflecting portion 330 may include an inclined surface having a predetermined inclination with respect to the optical plate 200 or a substrate 410 of the light source 400.

The reflecting portion 330 may include a first reflecting portion 330*a* and a second reflecting portion 330*b*. The first reflecting portion 330*a* and the second reflecting portion 330*b* may form a funnel shape.

The first reflecting portion 330*a* and the second reflecting portion 330*b* are connected to each other, both of which have an inclined surface respectively. Here, an acute angle formed by the top surface of the substrate 410 of the light source 400 and the inclined surface of the first reflecting portion 330*a* is less than an acute angle formed by the top surface of the substrate 410 and the inclined surface of the second reflecting portion 330*b*. As such, when the inclined surface of the first reflecting portion 330*a* is different from the inclined surface of the second reflecting portion 330*b*, the first reflecting portion 330*a* is able to collect the light emitted from the light source 400, and the second reflecting portion 330*b* is able to widely diffuse the light collected by the first reflecting portion 330*a*. As a result, optical efficiency of the entire lighting device can be improved.

The first reflecting portion 330*a* may re-reflect the light reflected by the inner surface of the optical plate 200 toward the optical plate 200.

The reflector 300 is disposed on the substrate 410 of the light source 400 and may be coupled to the substrate 410. To this end, the reflector 300 may include a projection 350 inserted into a hole 411 of the substrate 410. The projection 350 may be connected to the second reflecting portion 330*b* of the reflector 300. Here, the number of the projections 350 may correspond to the number of the holes 411 of the substrate 410.

Referring to the drawings, three projections 350 are disposed at a regular interval on the second reflecting portion 330*b*, as if the three projections 350 are disposed to form a regular triangle. Here, the three projections 350 may not be disposed at a regular interval. For example, the three projections 350 may be disposed to form an isosceles triangle. As such, when the three projections 350 are disposed at different intervals from each other, it is possible to easily check a direction in which the substrate 410 is coupled to the reflector 300 and where the substrate 410 is coupled to the reflector 300.

The reflector 300 may include a support 370. The support 370 supports the reflecting portion 330 on the heat sink 600. One end of the support 370 is connected to the heat sink 600 and the other end of the support 370 is connected to the reflecting portion 330. The at least two supports 370 may be provided. Although three supports 370 are shown in the drawings, the more than three supports 370 may be also disposed.

The support 370 is connected to the heat sink 600. The support 370 can be coupled to the heat sink 600 by means of a bolt B. The support 370 includes a recess into which the bolt B is inserted. The heat sink 600 also includes a hole 650 through which the bolt B passes.

The location of the driving unit 500 may be fixed by the coupling of the support 370 and the heat sink 600. This is because the support 370 passes through a through-hole 570 of a circuit board 510 of the driving unit 500 and is coupled to the heat sink 600.

The light source 400 emits light. The light source 400 is disposed on the heat sink 600 and may be coupled to the reflector 300. This will be described with reference to FIG. 6.

The light source 400 may include the substrate 410 and a light emitting device 430 disposed on the substrate 410.

The substrate 410 has a quadrangular plate shape. However, the substrate 410 may have various shapes without being limited to this. For example, the substrate 410 may have a circular or polygonal plate shape. The substrate 410 is formed by printing a circuit pattern on an insulator. For example, the substrate 410 may include a common printed circuit board (PCB), a metal core PCB, a flexible PCB, a ceramic PCB and the like. Also, the substrate 410 may include a chips on board (COB) allowing an unpackaged LED chip to be directly bonded to a printed circuit board. The substrate 410 may be formed of a material capable of efficiently reflecting light. The surface of the substrate 410 may have a color such as white, silver and the like capable of efficiently reflecting light.

The substrate 410 is disposed between the heat sink 600 and the reflector 300. Specifically, the substrate 410 is disposed on the heat sink 600, and the reflector 300 is disposed on the substrate 410. Here, the projection 350 of the reflector 300 shown in FIG. 5 is inserted into the hole 411 of the substrate 410 shown in FIG. 6, so that the substrate 410 comes to be coupled to the reflector 300 and it is possible to check a direction in which the substrate 410 is coupled to the reflector 300 and where the substrate 410 is coupled to the reflector 300.

The substrate 410 is electrically connected to the driving unit 500. However, the substrate 410 is physically separated from the driving unit 500. That is, the substrate 410 and the driving unit 500 are spatially separated from each other. Specifically, the substrate 410 is disposed on a projection 670 of the heat sink 600. The circuit board 510 of the driving unit 500 is disposed on a base 610 of the heat sink 600. In this manner, when the light source 400 and the driving unit 500 are physically or spatially separated from each other, there are advantages that heat from the driving unit 500 is not directly transferred to the light source 400 and the heat from the light source 400 is not directly transferred to the driving unit 500, so that the circuit parts of the driving unit 500 can be protected. Also, since the light source 400 and the driving unit 500 are disposed independently of each other, they can be easily maintained and repaired.

The substrate 410 is electrically connected to the circuit board 510 of the driving unit 500. The substrate 410 and the circuit board 510 may be connected to each other by means of a wire. Also, the substrate 410 and the circuit board 510 may be connected to each other by using a connector instead of the wire. The connector will be described in detail with reference to the accompanying drawings after the description of the driving unit 500.

A plurality of the light emitting devices 430 will be disposed on one side of the substrate 410.

The light emitting device 430 may be a light emitting diode chip emitting red, green and blue light or a light emitting diode chip emitting UV. Here, the light emitting diode may have a lateral type or vertical type and may emit blue, red, yellow or green light.

The light emitting device 430 may have a fluorescent material. When the light emitting diode is a blue light emitting diode, the fluorescent material may include at least any one selected from a group consisting of a garnet material (YAG, TAG), a silicate material, a nitride material and an oxynitride material.

The driving unit 500 receives electric power from the outside thereof and converts the electric power in conformity with the light source 400. Then, the driving unit 500 supplies the converted electric power to the light source 400.

The driving unit 500 may be received in the housing 100 and disposed on the base 610 of the heat sink 600.

The driving unit 500 may include the circuit board 510 and a plurality of parts 520 mounted on the circuit board 510. The plurality of the parts 520 may include, for example, a DC converter converting AC power supply supplied by an external power supply into DC power supply, a driving chip controlling the driving of the light source 400, and an electrostatic discharge (ESD) protective device for protecting the light source 400.

Though the circuit board 510 has a circular plate shape, the circuit board 510 may have various shapes without being limited to this. For example, the circuit board 510 may have an elliptical or polygonal plate shape. The circuit board 510 may be formed by printing a circuit pattern on an insulator.

The circuit board 510 may include the projecting plate 530. The projecting plate 530 may project or extend outwardly from the circuit board 510. Unlike the circuit board 510, the projecting plate 530 is disposed outside the housing 100 and receives electric power from the outside.

The projecting plate 530 may be inserted into the second recess 170 of the housing 100 and fixed to the housing 100 by means of the cover 180.

The projecting plate 530 may include a plurality of electrode pads 531. External electric power is supplied through the electrode pad 531. The electrode pad 531 is electrically connected to the circuit board 510 and supplies the electric power to the circuit board 510.

The circuit board 510 may include the key recess 550. The key 190 of the housing 100 is inserted into the key recess 550. The key recess 550 indicates a direction in which the circuit board 510 is coupled to the housing 100 and where the circuit board 510 is coupled to the housing 100.

The circuit board 510 may include an insertion hole 560. The insertion hole 560 may be disposed at the center of the circuit board 510. The projection 670 of the heat sink 600 is inserted into the insertion hole 560. The projection 670 of the heat sink 600 is disposed to pass through the insertion hole 560, so that the light source 400 and the driving unit 500 may be spatially or physically separated from each other.

The circuit board 510 may include the through-hole 570. The support 370 of the reflector 300 passes through the through-hole 570. Due to the through-hole 570, the circuit board 510 may be disposed between the reflector 300 and the heat sink 600.

The circuit board 510 is electrically connected to the substrate 410 of the light source 400. The circuit board 510 and the substrate 410 may be connected to each other by using a general wire. The circuit board 510 and the substrate 410 may be also connected to each other through the connector instead of the wire. The connector will be described with reference to FIGS. 6 to 8.

Figure 6:
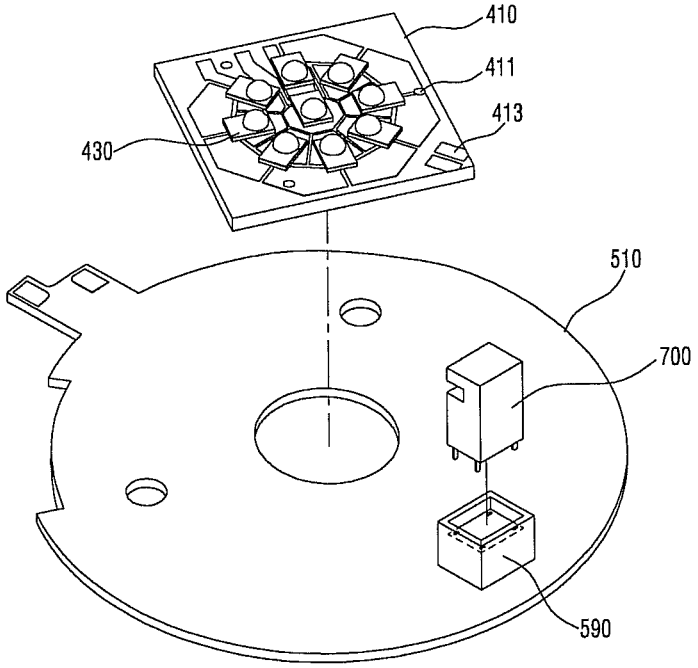
FIG. 6 is an exploded perspective view showing that a connector is added to a light source and a driving unit shown in FIG. 3.
Figure 7:
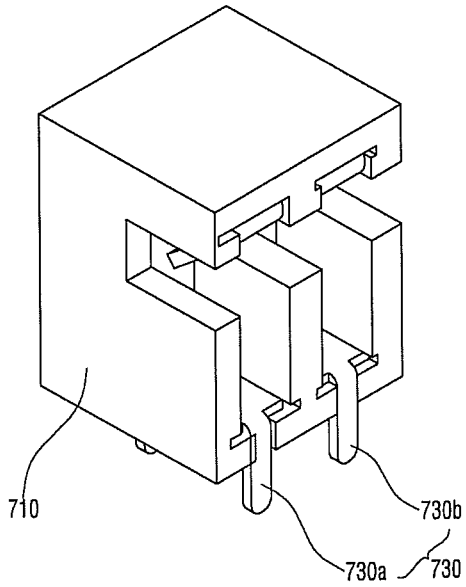
FIG. 7 is a perspective view of the connector shown in FIG. 6.
Figure 8:
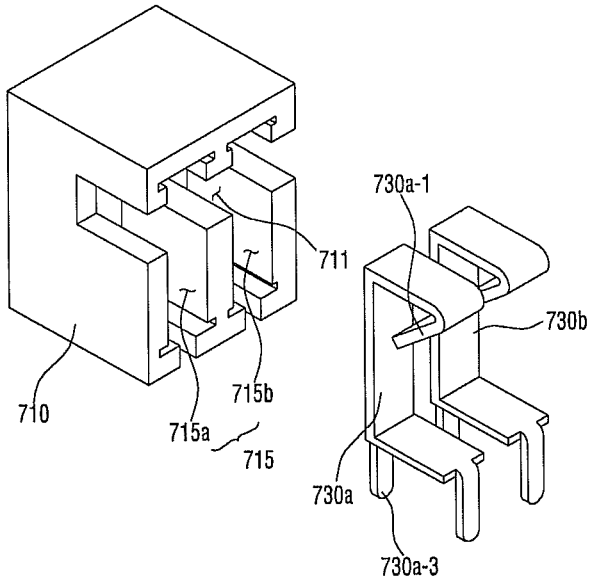
FIG. 8 is an exploded perspective view of the connector shown in FIG. 7.

FIG. 6 is an exploded perspective view showing that a connector is added to a light source and a driving unit shown in FIG. 3. FIG. 7 is a perspective view of the connector shown in FIG. 6. FIG. 8 is an exploded perspective view of the connector shown in FIG. 7.

The connector 700 electrically connects the circuit board 510 with the substrate 410. The connector 700 fixes the light source 400 on the driving unit 500 and makes it possible to easily check a direction in which the light source 400 and the driving unit 500 are coupled to each other and where the light source 400 and the driving unit 500 are coupled to each other.

The connector 700 may include an insulating body 710 and a conductor 730.

The insulating body 710 includes a receiving recess 715 for receiving the conductor 730. Specifically, the receiving recess 715 may include a first receiving recess 715*a* and a second receiving recess 715*b*. The first receiving recess 715*a* receives a first conductor 730*a*. The second receiving recess 715*b* receives a second conductor 730*b*. The first receiving recess 715*a* and the second receiving recess 715*b* are separated from each other without being connected to each other.

The insulating body 710 includes an insertion recess 711 into which a portion of the substrate 410 is inserted. Here, the direction of the receiving recess 715 may be substantially perpendicular to the direction of the insertion recess 711. The receiving recess 715 and the insertion recess 711 may be partially connected to each other. The substrate 410 may be fixed on the circuit board 510 by inserting the substrate 410 into the insertion recess 711.

A portion of the insulating body 710 is inserted into a docking 590 of the circuit board 510. Therefore, the conductor 730 and the circuit board 510 may be electrically and physically connected to each other.

The conductor 730 is received in the receiving recess 715 of the insulating body 710. The conductor 730 may include a first conductor 730*a* and a second conductor 730*b*. The first conductor 730*a* is received in the first receiving recess 715*a*. The second conductor 730*b* is received in the second receiving recess 715*b*. The first conductor 730*a* and the second conductor 730*b* are electrically and physically insulated from each other by the first receiving recess 715*a* and the second receiving recess 715*b*, both of which are disposed separately from each other.

The first conductor 730*a* includes a first contacting part 730*a*-1 contacting with an electrode pad 413 of the substrate 410. The first contacting part 730*a*-1 has a predetermined elasticity. Therefore, the first contacting part 730*a*-1 may press the substrate 410 by pressing the electrode pad 413 of the substrate 410.

The first contacting part 730*a*-1 includes a second contacting part 730*a*-3 which is physically connected to the docking 590 of the circuit board 510. When the second contacting part 730*a*-3 is inserted into the docking 590, the second contacting part 730*a*-3 is electrically connected to the circuit board 510.

Since the second conductor 730*b* is the same as the first conductor 730*a*, a description of the second conductor 730*b* will be replaced by the foregoing description of the first conductor 730*a*.

The heat sink 600 will be described with reference to FIGS. 1 to 5 again.

The heat sink 600 radiates heat from the light source 400 and the driving unit 500.

The heat sink 600 may include the base 610 and the projection 670.

The base 610 may have a circular plate shape having a predetermined depth and may have a first surface on which the circuit board 510 is disposed. The projection 670 may project or extend upward from the central portion of the base 610 and may have a second surface on which the substrate 410 is disposed.

Here, there is a predetermined level difference between the first surface and the second surface. The second surface is placed on the first surface. Due to the level difference between the first surface and the second surface, the substrate 410 and the circuit board 510 may be spatially separated from each other.

The circuit board 510 of the driving unit 500 is disposed on the base 610. The substrate 410 of the light source 400 is disposed on the projection 670. The projection 670 passes through the insertion hole 560 of the circuit board 510. The light source 400 and the driving unit 500 are physically and spatially separated from each other by the base 610 and the projection 670. Also, the light source 400 may be disposed on the driving unit 500 within the housing 100 by the base 610 and the projection 670.

The projection 670 may be integrally formed with the base 610. That is, the projection 670 and the base 610 may be manufactured in one body by diecasting.

Additionally, the projection 670 and the base 610 may be individually formed and coupled to each other. Specifically, this will be described with reference to FIGS. 9 to 11.

Figure 9:
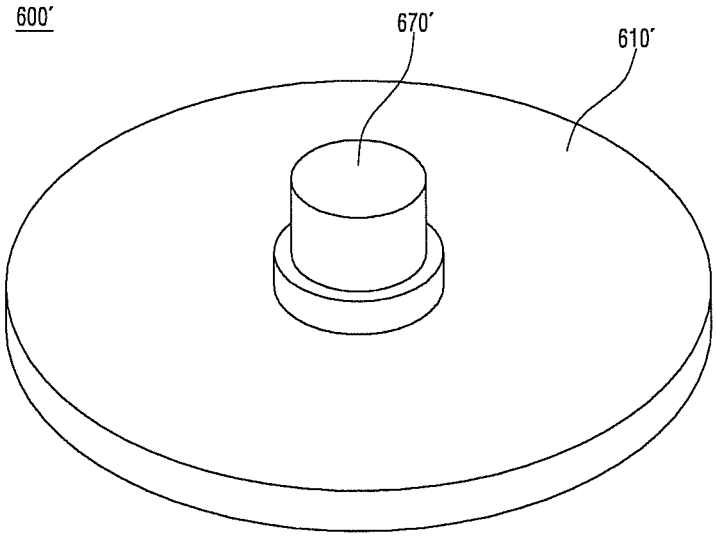
FIG. 9 is a perspective view showing a modified example of a heat sink shown in FIG. 3.
Figure 10:
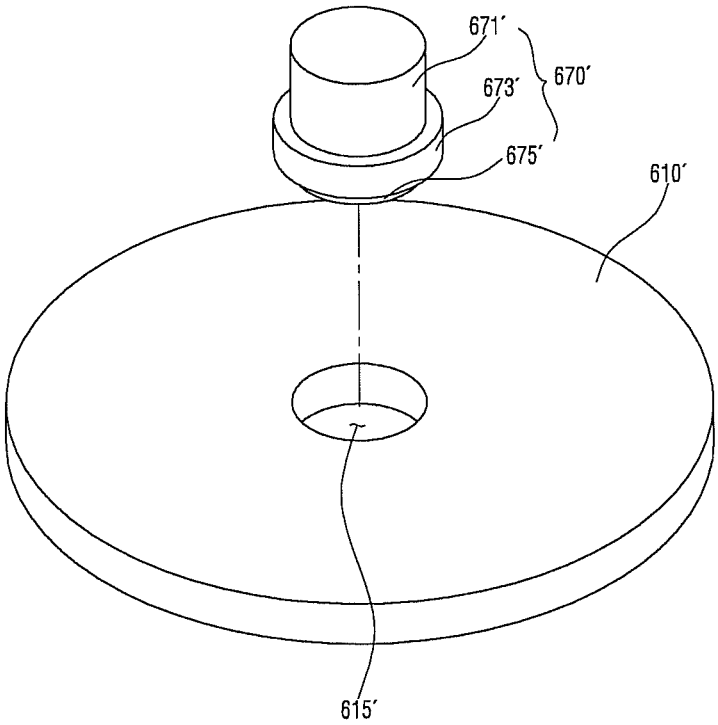
FIG. 10 is an exploded perspective view of the heat sink shown in FIG. 9.
Figure 11:
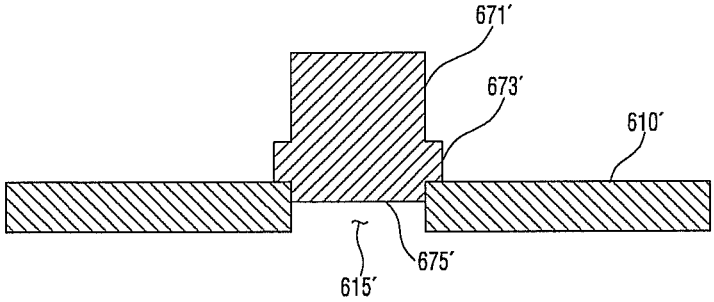
FIG. 11 is a cross sectional view of the heat sink shown in FIG. 9.

FIG. 9 is a perspective view showing a modified example of a heat sink shown in FIG. 3. FIG. 10 is an exploded perspective view of the heat sink shown in FIG. 9. FIG. 11 is a cross sectional view of the heat sink shown in FIG. 9.

A heat sink 600' shown in FIGS. 9 to 11 may include a base 610' and a projection 670'. Here, the heat sink 600' may include the other components of the heat sink 600 shown in FIGS. 3 and 4.

The base 610' is mostly the same as the base 610 shown in FIGS. 3 and 4.

The base 610' includes a hole 615' to which the projection 670' is coupled. The hole 615' may be formed at the central portion of the base 610'. Specifically, a coupling portion 675' of the projection 670' is coupled to the hole 615'. The coupling portion 675' may be coupled to the hole 615' in an interference fit manner.

The projection 670' is coupled to the base 610'. Specifically, the projection 670' is inserted into the hole 615' of the base 610'. The projection 670' may include a placement portion 671', a catching portion 673' and the coupling portion 675'.

The coupling portion 675' is inserted into the hole 615' of the base 610'. Here, the coupling portion 675' may be filled in a portion of the hole 615' of the base 610' in lieu of the entire hole 615'.

The catching portion 673' may have a shape projecting outwardly from the lateral surface of the placement portion 671'. When the projection 670' is coupled to the base 610', the catching portion 673' prevents the projection 670' from passing through the hole 615' of the base 610'. The catching portion 673' contacts with the top surface (a first surface) of the base 610'. Therefore, a contact area of the projection 670' and the base 610' becomes larger, thereby improving heat radiation performance.

The placement portion 671' includes the top surface (a second surface) on which the light source 400 is disposed and a lateral surface from which the catching portion 673' projects.

The base 610' and the projection 670' shown in FIGS. 9 to 11 may be coupled to each other by being processed by a press. Here, the projection 670' may be coupled to the hole 615' of the base 610' in an interference fit manner.

The heat sink 600' shown in FIGS. 9 to 11 is processed by a press. Since a contact area of the catching portion 673' and the base 610' becomes larger, the heat radiating characteristic of the heat sink 600' is better than that of the heat sink 600 shown in FIGS. 3 and 4.

Figure 12:
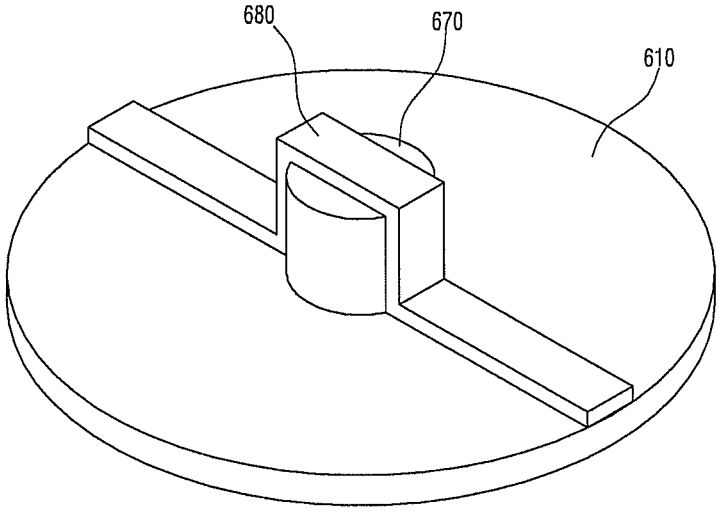
FIG. 12 is a perspective view showing a first modified example of the heat sink shown in FIG. 3.

FIG. 12 is a perspective view showing a first modified example of the heat sink shown in FIG. 3.

A heat sink 600" shown in FIG. 12 includes a heat pipe 680.

The heat pipe 680 may be disposed on the projection 670 and the base 610. The heat pipe 680 may be disposed on a portion of the base 610 and a portion of the projection 670. The heat pipe 680 has a shape in accordance with the shape of the projection 670. A portion of the heat pipe 680 may be bent in accordance with the projecting shape of the projection 670.

The heat pipe 680 may have a flat shape as well as a common tube shape. Here, the flat shape means that the cross section of the heat pipe 680 includes not only a geometrically perfect quadrangle but also an incomplete quadrangle of which each corner is curved.

The heat pipe 680 may quickly transfer the heat from the light source 400 which is shown in FIG. 3 and is disposed on the projection 670 to the base 610. The heat pipe 680 will be described in detail.

The heat pipe 680 has a predetermined interior space. The space is in a vacuum state without being connected to the outside. The space is disposed on the base 610 and the projection 670. The space may be connected from one end to the other end of the heat pipe 680 without being disconnected in the middle portion thereof.

A refrigerant having a low boiling point is placed in the space. The refrigerant may be particularly placed on the projection 670 in the space. The refrigerant may be any one of ammonia, Freon 11, Freon 113, acetone, methanol and ethanol. However, there is no limit to the refrigerant.

A member for transferring the refrigerant condensed in the outer circumference of the base 610 to the projection 670 may be disposed in the space. The member may be a textile using a capillary force, metal mesh and sintered powder. By using the capillary force, effects caused by gravity can be reduced.

The operation of the heat pipe 680 will be described. When the light source 400 disposed on the projection 670 operates to radiate heat, the refrigerant within the heat pipe 680 absorbs the heat and is evaporated into water vapor. The evaporated water vapor moves along the space within the heat pipe 680 to the base 610 having a relatively low temperature. Since the base 610 has a temperature relatively lower than that of the projection 670, the evaporated water vapor is liquefied in the outer circumference of the base 610 and is changed into the refrigerant. The refrigerant moves over the projection 670 along the heat pipe 680. Here, the refrigerant may moves by gravity or capillary force. When the capillary force is used, the foregoing member may be disposed within the heat pipe 680.

The heat pipe 680 has a thermal conductivity coefficient higher than those of silver, copper and aluminum. The heat pipe 680 can be used semi-permanently without a separate power.

Figure 13:
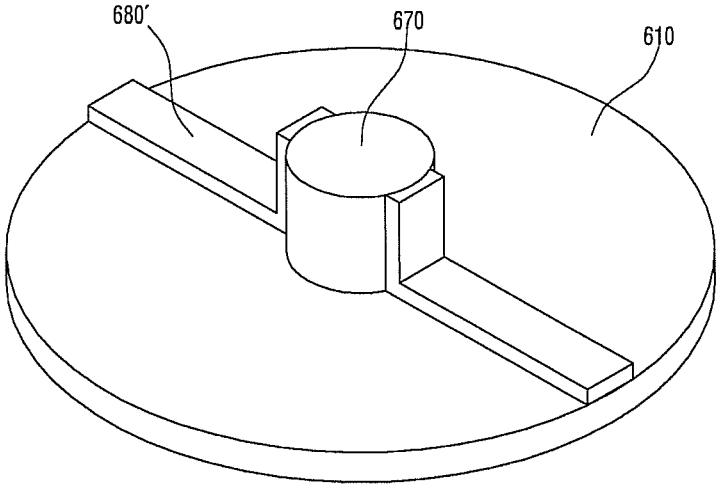
FIG. 13 is a perspective view showing a second modified example of the heat sink shown in FIG. 3.

FIG. 13 is a perspective view showing a second modified example of the heat sink shown in FIG. 3.

A heat sink 600'" shown in FIG. 13 include a heat pipe 680'. The heat pipe 680' shown in FIG. 13 has the same operation as that of the heat pipe 680 shown in FIG. 12. However, the heat pipe 680' shown in FIG. 13 has a different structure from that of the heat pipe 680 shown in FIG. 12.

The heat pipe 680' shown in FIG. 13 is disposed on the base 610 and the lateral surface of the projection 670.

A plurality of the heat pipes 680' are disposed. Though FIG. 13 shows that two heat pipes 680' are disposed in a line, three or more heat pipes 680' may be disposed, without being limited to this.

Figure 14:
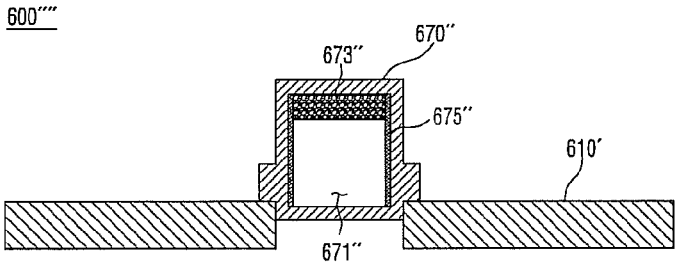
FIG. 14 is a perspective view showing a third modified example of the heat sink shown in FIG. 3.

FIG. 14 is a perspective view showing a third modified example of the heat sink shown in FIG. 3.

A heat sink 600"" shown in FIG. 14 includes the base 610' and a projection 670". The base 610' is the same as the base 610' shown in FIG. 11. The projection 670" has the same external appearance as that of the projection 670' shown in FIG. 11. However, the projection 670" has an internal structure different from that of the projection 670' shown in FIG. 11.

The projection 670" has an interior space 671". The space 671" is in a vacuum state. A refrigerant 673" is placed in the space 671". That is, the projection 670" includes the refrigerant 673".

The refrigerant 673" is filled in a portion of the space 671" in lieu of the entire space 671". Particularly, the refrigerant 673" may be placed under the top surface of the projection 670" or in the upper portion of the projection 670", that is, in an area which is the closest to the light source 400. Here, the refrigerant 673" may be any one of ammonia, Freon 11, Freon 113, acetone, methanol and ethanol. However, there is no limit to the refrigerant 673".

A member 675" may be disposed on the inner wall of the projection 670" or on the inner wall defining the space 671". The member 675" transfers the refrigerant liquefied in the lower portion of the projection 670" to the upper portion of the projection 670". The member 675" may be a textile using a capillary force in the vacuum state interior space 671", metal mesh and sintered powder. By using the capillary force, effects caused by gravity can be reduced.

The light source 400 disposed on the top surface of the projection 670" operates to generate heat. The generated heat evaporates the refrigerant 673" disposed in the interior space 671" of the projection 670" into water vapor. The evaporated water vapor moves to the lower portion of the projection 670", which has a relatively low temperature, and is liquefied again into the refrigerant in the lower portion of the projection 670". The liquefied refrigerant moves along the member 675" to the upper portion of the projection 670".

In the heat sink 600"" shown in FIG. 14, the projection 670" has a heat pipe structure. Therefore, the heat from the light source 400 can be quickly transferred to the base 610'.

Figure 15:
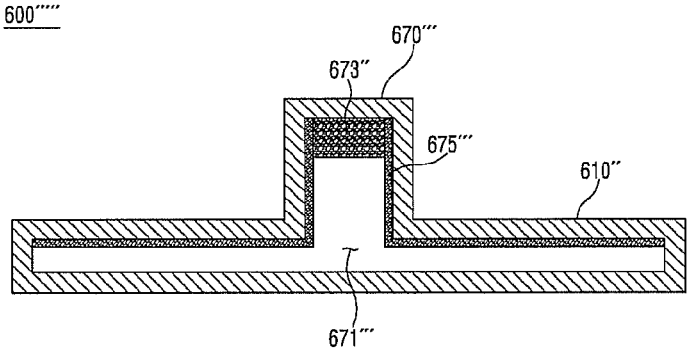
FIG. 15 is a perspective view showing a fourth modified example of the heat sink shown in FIG. 3.

FIG. 15 is a perspective view showing a fourth modified example of the heat sink shown in FIG. 3.

The heat sink 600""" shown in FIG. 15 includes a base 610" and a projection 670'". The base 610" has the same external appearance as that of the base 610 shown in FIGS. 12 and 13. However, the base 610" has an internal structure different from that of the base 610 shown in FIGS. 12 and 13. The projection 670'" has the same external appearance as that of the projection 670 shown in FIGS. 12 and 13. However, the projection 670'" has an internal structure different from that of the projection 670 shown in FIGS. 12 and 13.

The base 610" has a portion of an interior space 671'". The projection 670'" has the rest of the interior space 671'". The space 671'" has a shape in accordance with the shapes of the base 610" and the projection 670'". The space 671'" is integrally formed and is in a vacuum state. The refrigerant 673" is placed in the space 671'".

The refrigerant 673" is filled in a portion of the space 671'" in lieu of the entire space 671'". Particularly, the refrigerant 673" may be placed under the top surface of the projection 670'" or in the upper portion of the projection 670'", that is, in an area which is the closest to the light source 400.

A member 675'" may be disposed on the inner wall defining the space 671'". The member 675' may be disposed between the inner wall of the projection 670'" and the inner wall of the base 610". The member 675'" transfers the refrigerant liquefied in the outer circumference of the base 610" to the upper portion of the projection 670'". The member 675'" may be a textile using a capillary force in the vacuum state interior space 671'", metal mesh and sintered powder. By using the capillary force, effects caused by gravity can be reduced.

The light source 400 disposed on the top surface of the projection 670'" operates to generate heat. The generated heat evaporates the refrigerant 673" disposed in the interior space 671'" of the projection 670'" into water vapor. The evaporated water vapor moves to the outer circumference of the base 610" via the lower portion of the projection 670'", which has a relatively low temperature, and is liquefied again into the refrigerant in the outer circumference of the base 610". The liquefied refrigerant moves along the member 675'" to the upper portion of the projection 670'".

In the heat sink 600""" shown in FIG. 15, the base 610" and the projection 670'" has a heat pipe structure. Therefore, the heat from the light source 400 can be quickly transferred to the base 610".

Figure 16:
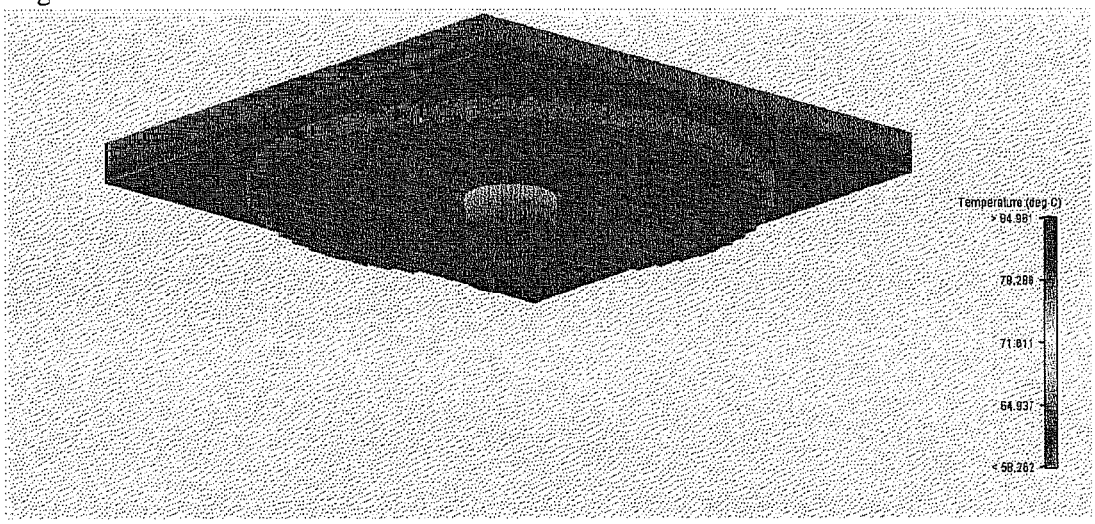
FIG. 16 is a view showing heat distribution of the heat sink shown in FIG. 3.
Figure 17:
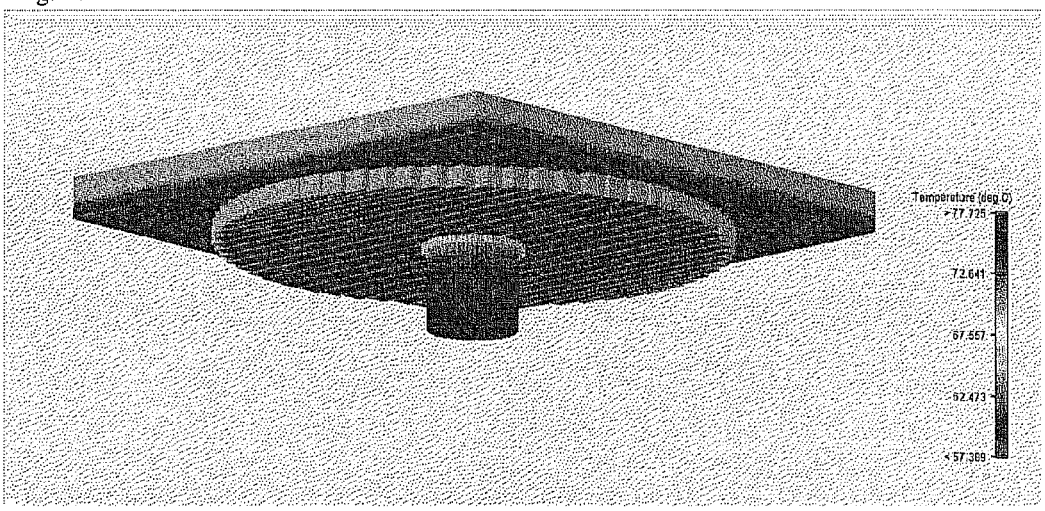
FIG. 17 is a view showing heat distribution of the heat sink shown in FIG. 9.
Figure 18:
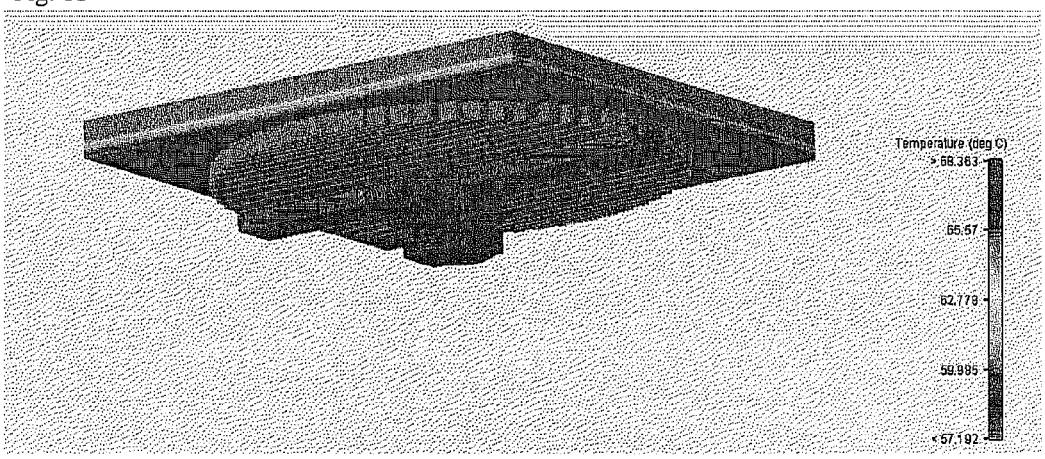
FIG. 18 is a view showing heat distribution of the heat sink shown in FIG. 12.
Figure 19:
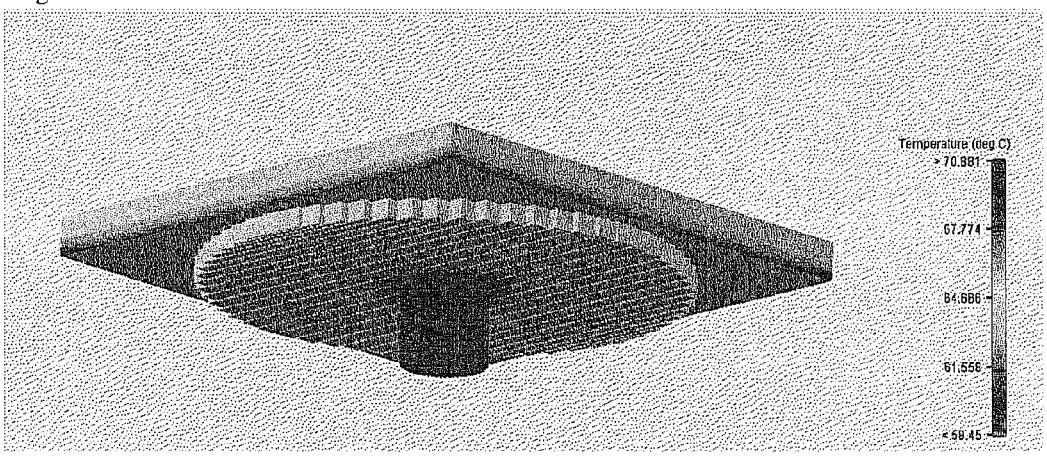
FIG. 19 is a view showing heat distribution of the heat sink shown in FIG. 14.
Figure 20:
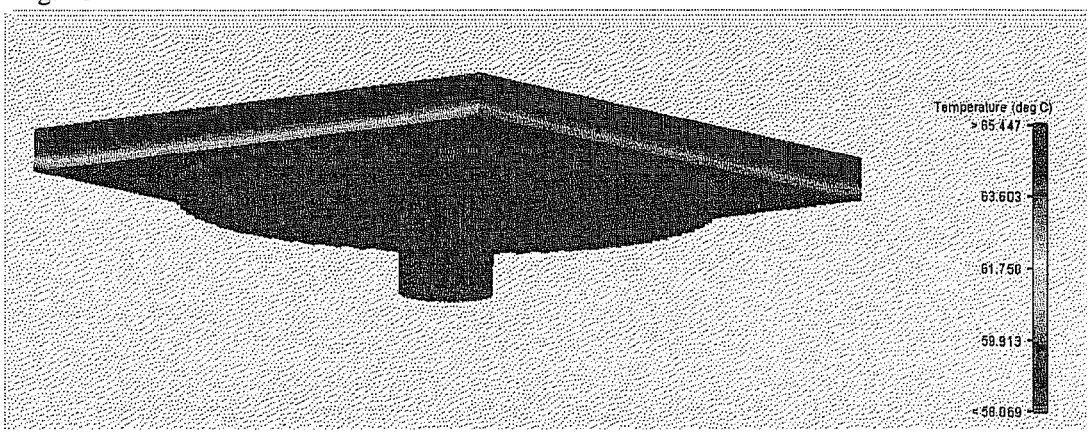
FIG. 20 is a view showing heat distribution of the heat sink shown in FIG. 15.

FIG. 16 is a view showing heat distribution of the heat sink 600 shown in FIG. 3. FIG. 17 is a view showing heat distribution of the heat sink 600' shown in FIG. 9. FIG. 18 is a view showing heat distribution of the heat sink 600" shown in FIG. 12. FIG. 19 is a view showing heat distribution of the heat sink 600"" shown in FIG. 14. FIG. 20 is a view showing heat distribution of the heat sink 600""" shown in FIG. 15.

FIGS. 16 to 20 show results obtained from experiments in which constant heat (20 W) is supplied during a certain period of time.

It is measured that the maximum temperature of the projection of the heat sink 600 of FIG. 16 is about 85.96 degree, the maximum temperature of the projection of the heat sink 600' of FIG. 17 is about 77.72 degree, the maximum temperature of the projection of the heat sink 600" of FIG. 18 is about 63.30 degree, the maximum temperature of the projection of the heat sink 600"" of FIG. 19 is about 70.88 degree, and the maximum temperature of the projection of the heat sink 600""" of FIG. 20 is about 65.45 degree.

To summarize the experimental results, it was found that the heat sink 600""" of FIG. 20 has the most excellent heat radiation performance.

Referring back to FIGS. 1 to 5, the heat sink 600 may include the projection 620. The projection 620 may project outwardly from the outer circumference of the base 610. Here, the projection 620 may project in a direction substantially perpendicular to the direction in which the heat sink 600 is received in the housing 100. The projection 620 is inserted into the first recess 150 of the housing 100. Through this, the heat sink 600 is not inserted inside the housing 100 and blocks the bottom opening **110*b* of the housing 100**.

The heat sink 600 may include the key recess 630. The key recess 630 may be dug in the direction of the projection 670 from the outer circumference of the base 610. The key 190 of the housing 100 is inserted into the key recess 630. The key recess 630 indicates a direction in which the heat sink 600 is coupled to the housing 100 and where the heat sink 600 is coupled to the housing 100.

The heat sink 600 includes the hole 650 through which the bolt B passes. The hole 650 is disposed corresponding to the support 370 of the reflector 300.

The heat sink 600 may be formed of a metallic material or a resin material, each of which has excellent heat radiation efficiency. However, there is no limit to the material of the heat sink 600. For example, the material of the heat sink 600 may include at least one of Al, Ni, Cu, Ag and Sn.

The heat sink 600 may include a thermal pad 690. The thermal pad 690 may be disposed between the base 610 of the heat sink 600 and the circuit board 510 of the driving unit 500. The thermal pad 690 may be also disposed on a portion of the base 610. The thermal pad 690 has a predetermined depth and is able to quickly transfer heat generated from the circuit board 510 of the driving unit 500 to the base 610. Here, the thermal pad 690 may be only on a particular portion of the circuit board 510. That is, the thermal pad 690 may be disposed only on a part particularly emitting more heat among many parts 520 disposed on the circuit board 510. For example, the thermal pad 690 may be disposed only under a transformer.

Figure 21:
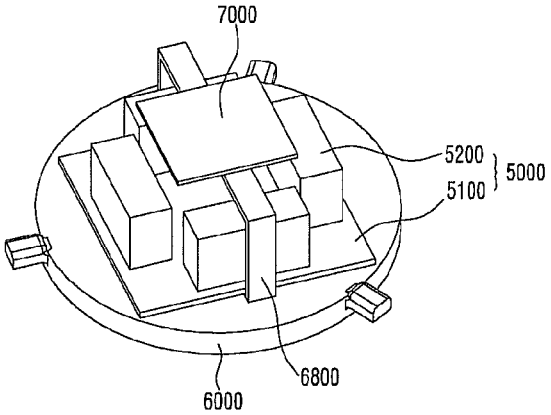
FIG. 21 is a perspective view showing another example of the lighting device shown in FIG. 1.
Figure 22:
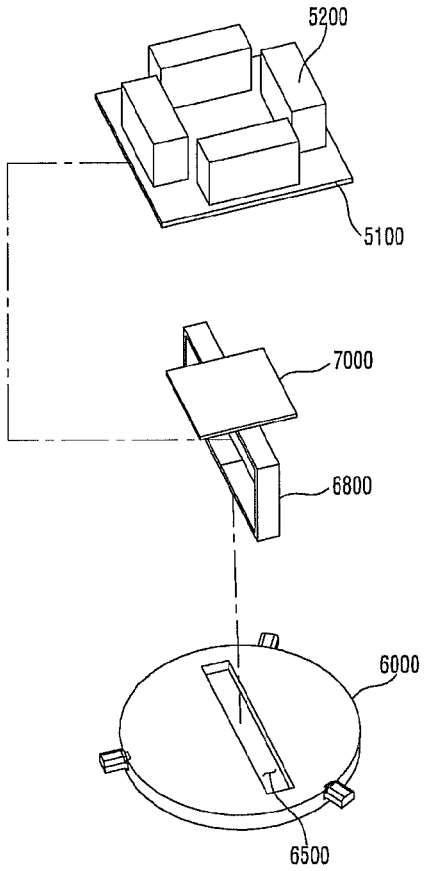
FIG. 22 is an exploded perspective view of the lighting device shown in FIG. 21.

FIG. 21 is a perspective view showing a modified example of some components among the components of the lighting device shown in FIG. 1. FIG. 22 is an exploded perspective view of FIG. 21.

The lighting device shown in FIGS. 21 and 22 may include a driving unit 5000, a heat sink 6000, a heat pipe 6800 and a support plate 7000. The lighting device shown in FIGS. 21 and 22 may further include the housing 100, the optical plate 200, the reflector 300 and the light source 400, all of which are shown in FIGS. 1 to 4. Since the housing 100, the optical plate 200, the reflector 300 and the light source 400 have been described above, the driving unit 5000, the heat sink 6000, the heat pipe 6800 and the support plate 7000 will be described in detail.

The heat sink 6000 has a circular plate shape.

The heat sink 6000 may include a receiver 6500 which is coupled to a portion of the heat pipe 6800. The receiver 6500 functions to fix the heat pipe 6800 on the heat sink 6000. The receiver 6500 may be disposed in the top surface of the heat sink 6000. The receiver 6500 may be a receiving recess into which the lower portion of the heat pipe 6800 is inserted. The receiving recess 6500 has a shape corresponding to the lower portion of the heat pipe 6800.

Though FIG. 22 shows that the receiver 6500 is disposed in the top surface of the heat sink 6000, there is no limit to this. For example, the receiver 6500 may be formed in the lateral surface of the heat sink 6000 or may be disposed in the bottom surface of the heat sink 6000. In this case, the shape of the heat pipe 6800 may be changed corresponding to the receiver 6500 of the heat sink 6000. Various shapes of the heat pipe 6800 will be described later.

The driving unit 5000 is disposed on the heat sink 6000. Specifically, the driving unit 5000 is disposed on the top surface of the heat sink 6000. The driving unit 5000 may include circuit board 5100 and a plurality of parts 5200 mounted on the circuit board 5100.

The driving unit 5000 is surrounded by the heat pipe 6800.

In FIGS. 21 and 22, the circuit board 5100 has a quadrangular plate shape. However, there is no limit to the shape of the circuit board 5100. For example, the circuit board 5100 may have a circular or polygonal plate shape.

The light source 400 shown in FIG. 3 is disposed on the heat pipe 6800. The heat pipe 6800 places the light source 400 on the driving unit 5000 and transfers the heat generated from the light source 400 to the heat sink 6000.

It is recommended that the width of the heat pipe 6800 is at least the same as or greater than the width of the substrate 410 of the light source 400 shown in FIG. 3. In other words, it is preferable that the entire bottom surface of the substrate 410 of the light source 400 contacts with the heat pipe 6800.

The heat pipe 6800 is disposed on the heat sink 6000. Here, a plurality of the heat pipes 6800 may be disposed on the heat sink 6000. For example, two or more heat pipes 6800 may be connected to each other and disposed on the heat sink 6000 or may be disposed separately from each other on the heat sink 6000. By using the plurality of the heat pipes 6800, it is possible to improve heat transfer efficiency and to obtain more enhanced heat radiation efficiency than that of a case where the width of the heat pipe 6800 is less than the width of the substrate 410 of the light source 400 shown in FIG. 3.

The heat pipe 6800 is disposed in the receiver 6500 of the heat sink 6000, so that the heat pipe 6800 is coupled to the heat sink 6000.

A refrigerant having a low boiling point is placed within the heat pipe 6800. Since the detailed description of the structure of the heat pipe 6800 has been provided above, descriptions thereof will be omitted.

The heat pipe 6800 has a structure surrounding the driving unit 5000. This will be described in detail with reference to FIG. 23.

Figure 23:
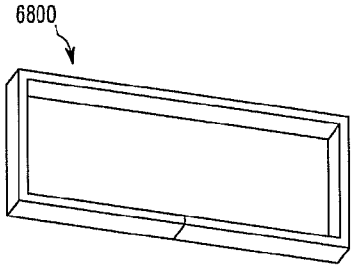
FIG. 23 is a perspective view of only a heat pipe shown in FIG. 21.

FIG. 23 is a perspective view of only a heat pipe shown in FIG. 21.

Referring to FIG. 23, the heat pipe 6800 may be manufactured by bending one straight-shaped heat pipe in the form of a quadrangle a plurality of number of times. In this case, both ends of the straight-shaped heat pipe may be connected to each other.

Figure 24:
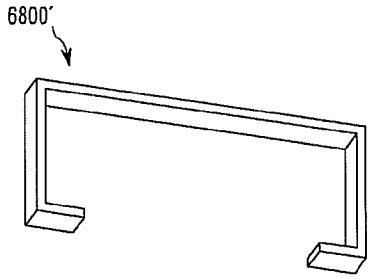
FIG. 24 is a perspective view showing a modified example of the heat pipe shown in FIG. 23.

FIG. 24 is a perspective view showing a modified example of the heat pipe shown in FIG. 23.

Referring to FIG. 24, a heat pipe 6800' is manufactured by bending one straight-shaped heat pipe a plurality of number of times. In the heat pipe 6800' shown in FIG. 24, both ends of the straight-shaped heat pipe are not connected to each other.

The heat pipe 6800' having such a structure may change the structure of the receiver 6500 of the heat sink 6000 shown in FIG. 22. For example, the receiver 6500 may be formed in the lateral surface of the heat sink 6000. That is, recesses into which both ends of the heat pipe 6800' are inserted respectively may be formed in the lateral surface of the heat sink 6000.

Figure 25:
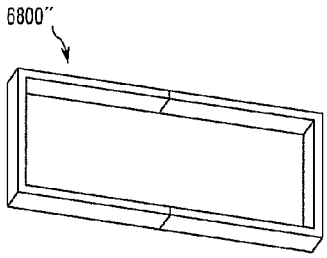
FIG. 25 is a perspective view showing a modified example of the heat pipe shown in FIG. 23.

FIG. 25 is a perspective view showing a modified example of the heat pipe shown in FIG. 23.

Referring to FIG. 25, a heat pipe 6800" may be manufactured by using two straight-shaped heat pipes. In this case, each heat pipe has a shape bent in the form of a quadrangle of which one side is open. Two heat pipes are connected to each other.

Referring back to FIGS. 21 and 22, the lighting device according to the embodiment may include the support plate 7000.

The support plate 7000 may be disposed on the heat pipe 6800. Specifically, the support plate 7000 may be disposed at the central portion of the upper portion of the heat pipe 6800. The support plate 7000 may be formed of a metallic material having high thermal conductivity.

The support plate 7000 may be coupled to the heat pipe 6800 by means of a thermal conductive tape, a resin having both adhesiveness and thermal conductivity, and the like.

The light source 400 shown in FIG. 3 may be disposed on the support plate 7000. The support plate 7000 transfers the heat generated from the light source 400 to the heat pipe 6800. The support plate 7000 can be usefully used when the width of the heat pipe 6800 less than the width of the substrate 410 of the light source 400. Also, the support plate 7000 can be usefully used in the heat pipe 6800" shown in FIG. 25. That is, the support plate 7000 is able to connect the two heat pipes having a quadrangular shape of which one side is open.

The support plate 7000 may have a shape corresponding to the substrate 410 of the light source 400 shown in FIG. 3.

Figure 26:
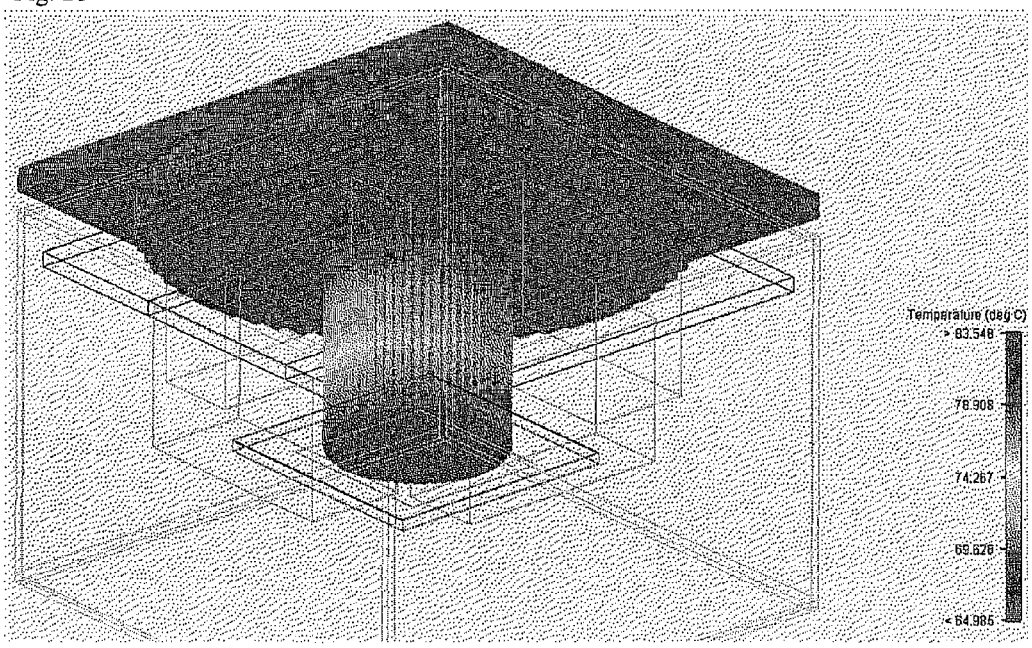
FIG. 26 is a view showing heat distribution of the heat sink shown in FIG. 3.
Figure 27:
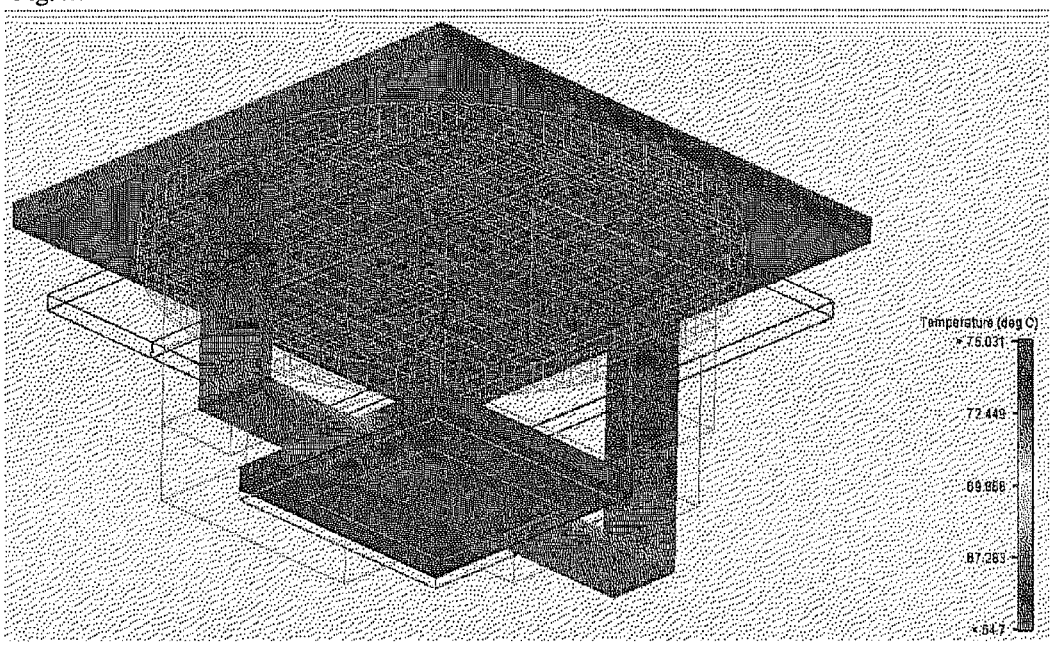
FIG. 27 is a view showing heat distributions of the heat sink, heat pipe and support plate shown in FIG. 21.

FIG. 26 is a view showing heat distribution of the heat sink 600 shown in FIG. 3. FIG. 27 is a view showing heat distributions of the heat sink 6000, heat pipe 6800 and support plate 7000 shown in FIG. 21. FIGS. 26 and 27 show experimental results under the same conditions.

It is measured that the maximum temperature of FIG. 26 is about 83.56 degree and the maximum temperature of FIG. 27 is about 75.03 degree. According to the experimental results, it can be seen that the lighting device shown in FIG. 27 has more excellent heat radiation performance than that of the lighting device shown in FIG. 26.

Although embodiments of the present invention were described above, these are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

The invention claimed is:

1. A lighting device comprising:

a housing having a top opening and a bottom opening;

an optical plate disposed in the top opening;

a heat sink disposed in the bottom opening, wherein the heat sink includes a base and a projection at the base;

a driving unit received in the housing, the driving unit disposed between the optical plate and the heat sink, and the driving unit to receive external electric power, wherein the driving unit includes a circuit board and a plurality of parts on the circuit board;

a light source received in the housing, the light source disposed between the optical plate and the driving unit, and the light source is electrically connected to the driving unit, wherein the light source includes a substrate and a light emitting device on the substrate, and a reflector received in the housing, the reflector being between the optical plate and the light source, wherein the reflector includes:

a reflecting portion that reflects light from the light source to the optical plate, and a support that supports the reflecting portion, the support extending from a surface of the reflector to the base of the heat sink, the support to be provided adjacent to a side edge of the substrate, the support to pass through a hole of the circuit board of the driving unit and the support to be provided at the base of the heat sink, wherein the substrate of the light source is on the projection of the heat sink, wherein the circuit board of the driving unit is disposed on the base of the heat sink, wherein the housing is coupled to the base of the heat sink, wherein the substrate of the light source is separated from the circuit board of the driving unit, wherein a diameter of the projection is less than a diameter of the base, wherein the projection is disposed between the plurality of parts of the driving unit, and wherein the projection contacts a top surface of the base.

2. The lighting device of claim 1, wherein the reflecting portion comprises at least two inclined surfaces.

3. The lighting device of claim 1, wherein the substrate of the light source has a hole, and wherein the reflecting portion comprises a projection inserted into the hole of the substrate, wherein the support is a different structure than the projection.

4. The lighting device of claim 1, wherein the housing comprises a catching portion, wherein the reflector includes a catching projection coupled to the catching portion, and wherein the catching projection is coupled to the catching portion by rotating about a direction in which the reflector is received in the housing.

5. The lighting device of claim 4, wherein a diameter of the optical plate is larger than a diameter of the top opening of the housing, and wherein the optical plate is fixed to the top opening of the housing by the coupling of the catching projection of the reflector and the catching portion of the housing.

6. The lighting device of claim 1, wherein the housing comprises a key, and wherein the driving unit and the heat sink respectively comprise a key recess into which the key is inserted.

7. The lighting device of claim 6, wherein the key recess of the driving unit is larger than the key recess of the heat sink.

8. The lighting device of claim 1, further comprising a thermal pad disposed between the circuit board of the driving unit and the base of the heat sink, wherein the thermal pad is disposed on a portion of the base of heat sink.

9. A lighting device comprising:

a housing that includes an upper portion and a lower portion;

a heat sink that includes a base and a projection disposed on the base, wherein the base includes a hole, wherein the base is coupled to the lower portion of the housing;

a light source that is disposed on the projection, wherein the light source includes a substrate and a light emitting device on the substrate;

an optical plate disposed on the light source;

a reflector disposed between the optical plate and the base of the heat sink; and a driving unit that is disposed on the base and is electrically connected to the light source, wherein the driving unit includes a circuit board and a plurality of parts on the circuit board, wherein the reflector includes an opening on which the light emitting device is disposed and a side surface to reflect light from the light emitting device, wherein the side surface of the reflector includes a first side surface having a first inclination with respect to the substrate, and a second side surface having a second inclination with respect to the substrate, wherein the first inclination is different from the second inclination, wherein the second side surface is disposed on the substrate, wherein the first side surface is disposed on the second side surface and is connected to the second side surface, and wherein the first side surface is not parallel to one side of the optical plate, wherein the reflector includes:

a reflecting portion that reflects light from the light source, and a support that supports the reflecting portion, the support extending from a surface of the reflector to the base of the heat sink, the support to be provided adjacent to a side edge of the substrate, the support to pass through a hole of the circuit board of the driving unit and the support to be provided at the base of the heat sink, and an attachment is to be provided through the hole of the base and to be provided at the support of the reflector.

10. The lighting device of claim 9, wherein the circuit board of the driving unit includes the hole through which the support passes.

11. The lighting device of claim 9, comprising a connector that electrically connects the light source with the driving unit and fixes the light source on the driving unit.

12. The lighting device of claim 11, wherein the connector comprises a conductor and an insulating body in which the conductor is disposed and that includes an insertion recess, wherein the light source of which a portion is inserted into the insertion recess of the insulating body includes an electrode pad electrically connected to the conductor, and wherein the driving unit includes a docking coupled to a portion of the insulating body and is electrically connected to the conductor of the connector.

13. The lighting device of claim 9, wherein the heat sink has a heat pipe structure therewithin.

14. A lighting device comprising:

a heat sink including a base;

a housing coupled to the base of the heat sink;

a driving unit that includes a circuit board disposed on the base of the heat sink and a plurality of parts disposed on the circuit board;

a light source disposed on the circuit board of the driving unit, and including a substrate and a light emitting device disposed on the substrate;

a heat pipe of which a portion is disposed between the circuit board of the driving unit and the light source, the heat pipe to transfer heat generated from the light source to the heat sink and support the light source such that the light source is disposed on the driving unit, wherein the heat pipe is disposed between the base of the heat sink and the light source, and wherein the light source is apart from the circuit board of the driving unit; and a reflector that includes:

a reflecting portion that reflects light from the light source, and a support that supports the reflecting portion, the support extending from a surface of the reflector to the base of the heat sink, the support to be provided adjacent to a side edge of the substrate, the support to pass through a hole of the circuit board of the driving unit and the support to be provided at the base of the heat sink.

15. The lighting device of claim 14, wherein the heat sink comprises a receiver for receiving a portion of the heat pipe in order to fix the heat pipe.

16. The lighting device of claim 14, further comprising a support plate disposed between the heat pipe and the light source.

* * * * *